US010583900B1

(12) United States Patent
Jankowski

(10) Patent No.: US 10,583,900 B1
(45) Date of Patent: Mar. 10, 2020

(54) ARRANGEMENT FOR EVACUATING PEOPLE FROM AN OFFSHORE INSTALLATION

(71) Applicant: Jacek Jankowski, Warsaw (PL)

(72) Inventor: Jacek Jankowski, Warsaw (PL)

( * ) Notice: Subject to any disclaimer, the term of this patent is extended or adjusted under 35 U.S.C. 154(b) by 0 days.

(21) Appl. No.: 16/148,128

(22) Filed: Oct. 1, 2018

(51) Int. Cl.
*B63B 23/28* (2006.01)
*B63B 23/48* (2006.01)
*B63B 23/16* (2006.01)

(52) U.S. Cl.
CPC ..... *B63B 23/28* (2013.01); *B63B 23/48* (2013.01); *B63B 23/16* (2013.01)

(58) Field of Classification Search
CPC ..... B63B 23/28; B63B 23/30; B63B 23/32
See application file for complete search history.

(56) References Cited

U.S. PATENT DOCUMENTS 1,130,569 A * 3/1915 Cocking ..... B63B 23/04 114/366

FOREIGN PATENT DOCUMENTS

GB 2086313 A * 5/1982 ..... B63B 23/30

* cited by examiner

*Primary Examiner* — Andrew Polay
(74) *Attorney, Agent, or Firm* — Neifeld IP Law, PC

(57) ABSTRACT

An arrangement for evacuating people from an offshore installation having a lifeboat and an arrangement for a free-fall based lifeboat launch with a tilted ramp characterised in that the ramp of the free-fall launching arrangement is mounted on the ramp axle, has a wire rope winch and is movable. The power hydraulic mechanism of the ramp consists of an arrangement of the two lower and upper identical hydraulic cylinders, a gear bar, a gearwheel of the ramp axle and the additional gearwheel of the gear bar. Piston rods of hydraulic cylinders are arranged on two opposite sides of the gear bar and are connected to the ends of the gear bar. The gear bar engages with the additional gearwheel engaging with the gearwheel of the ramp axle.

1 Claim, 3 Drawing Sheets

ARRANGEMENT FOR EVACUATING PEOPLE FROM AN OFFSHORE INSTALLATION

TECHNICAL FIELD

The present application and the resultant patent relate generally to lifeboats and more particularly relate to a lifeboat launching arrangement from an offshore installation.

BACKGROUND OF THE INVENTION

There are lifeboat launching appliances from offshore installations, wherein the lifeboat can be launched as a free fall lifeboat or wherein the lifeboat can be launched by falls. The free fall lifeboat launching from an oil rig usually means that the lifeboat is stored on a tilted ramp and can be slid through the ramp into the water under its own weight if a holdback is released. The lifeboat can be recovered usually by a hydraulic davit and a spreader of a wire rope winch. The lifeboat launching from an oil rig by falling under gravity usually means that the lifeboat is stored above sea level and can be lowered into the water by fall of a winch under its own weight if a brake of the winch is released. The lifeboat can be recovered by the opposite operation of the same wire rope winch. In currently used solutions for free-fall based lifeboat launching arrangements, the ramp is a fixed element of the arrangement and it is inseparably connected with the oil rig structure.

The disadvantage of the currently used evacuation arrangements from an oil rig using a lifeboat launched by free fall is that such an arrangement does not provide safe evacuation by lifeboat from an oil rig in any possible circumstances, since launching a lifeboat by free fall is not safe if the water surface is covered with obstacles such as floating ice blocks or construction fragments being a result of an explosion on the oil rig, as it risks damaging or breaking the lifeboat, even more so in conditions of limited visibility or at night.

Despite the fact that currently used free-fall based lifeboat launching arrangements are equipped with a second arrangement that allow for launching the same lifeboat by falls, this method cannot replace a separate lifeboat launching arrangement by fall of a winch. This arrangement is used to recover a lifeboat and it does not meet the requirements and standards for launching lifeboats by fall of a winch, as the lifeboat is moved out of the ramp and lowered into the water using a power supply, and the lifeboat holdback release arrangement consists in manually removing the slings from hooks.

This situation can be currently tackled only by equipping oil rigs with both lifeboat launching arrangements in parallel.

The invention overcomes the indicated drawbacks of the currently used lifeboat launching arrangements by free fall from oil rigs. The arrangement of the invention allows for launching the same lifeboat of the free-fall launching arrangement also by fall of a lifeboat winch in case of an emergency situation and while a power supply is off, which complies with the requirements and standards for this type of launching.

The invention is advantageous in that the arrangement replaces two different separate lifeboat launching arrangements.

The invention is designed to improve the safety of evacuation of people from an oil rig using a lifeboat.

SUMMARY OF THE INVENTION

The present application provides an arrangement for evacuating people from an offshore installation, comprising a lifeboat, a movable ramp and a lifeboat winch, characterised in that the ramp is mounted on the ramp axle. The ramp has an arrangement that allows it to be gravitationally lowered from below the lifeboat, allowing for the lifeboat to be gravitationally launched by fall of a lifeboat winch. This arrangement consists of a power hydraulic mechanism and a ramp winch. The power hydraulic mechanism consists of an arrangement of two identical hydraulic cylinders, a gear bar and gearwheels connected to the ramp axle. The cylinders work in one power hydraulic circuit, in which the movement of one cylinder forces a reverse movement, of the other cylinder. The possibility of designating the speed of travel of the piston rods allows for determining the safe speed of lowering the ramp from under the lifeboat, after releasing the brake of the ramp winch, with the wire ropes of which the end of the ramp is connected.

BRIEF DESCRIPTION OF THE DRAWINGS

The invention is illustrated in the embodiment in the drawing in axonometric view, where.

DETAILED DESCRIPTION

Figure 1:
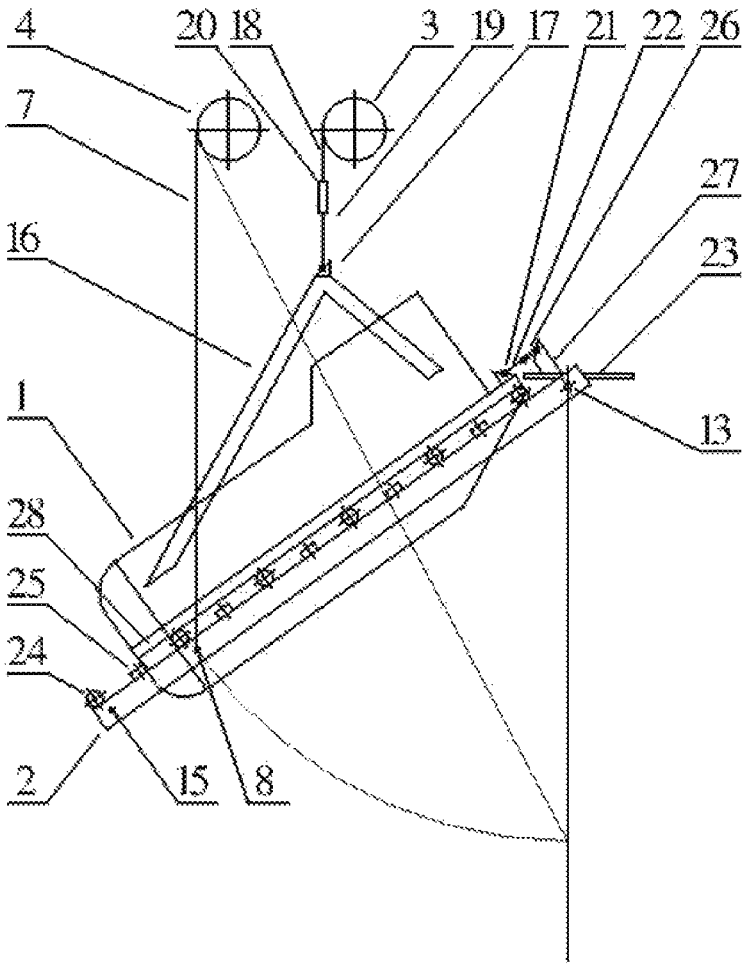
FIG. 1 is a side view of the entire lifeboat launching arrangement corresponding to the situation while the lifeboat is ready for launching.
Figure 2:
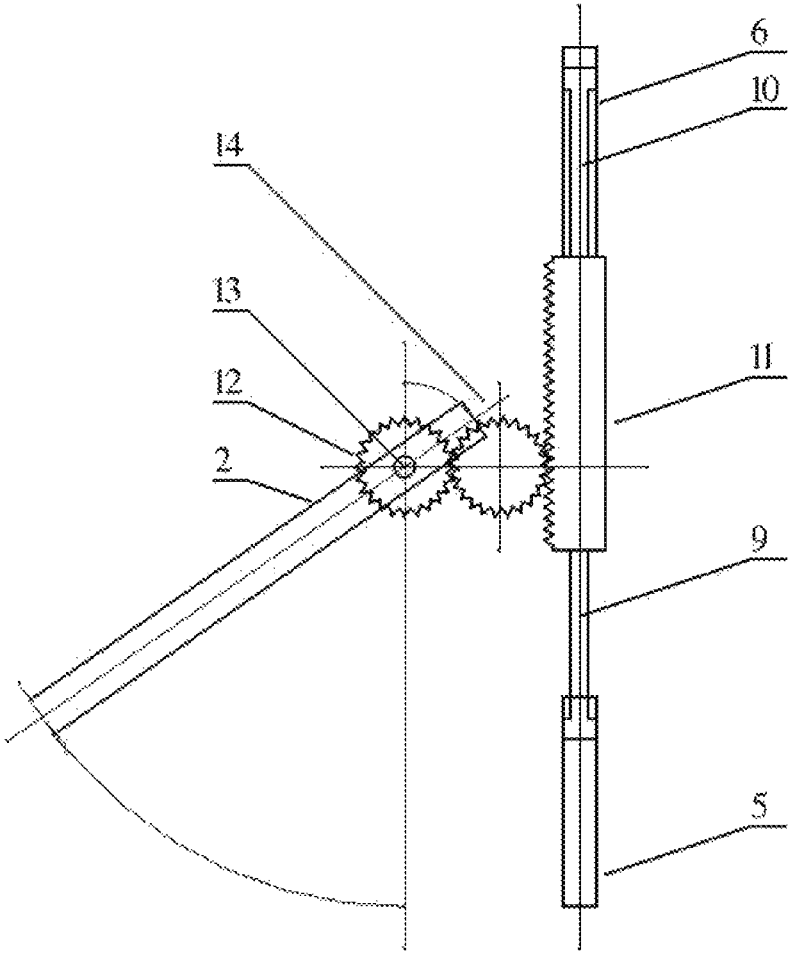
FIG. 2 is a side view of the ramp lowering mechanism corresponding to the situation while the ramp is fully raised.
Figure 3:
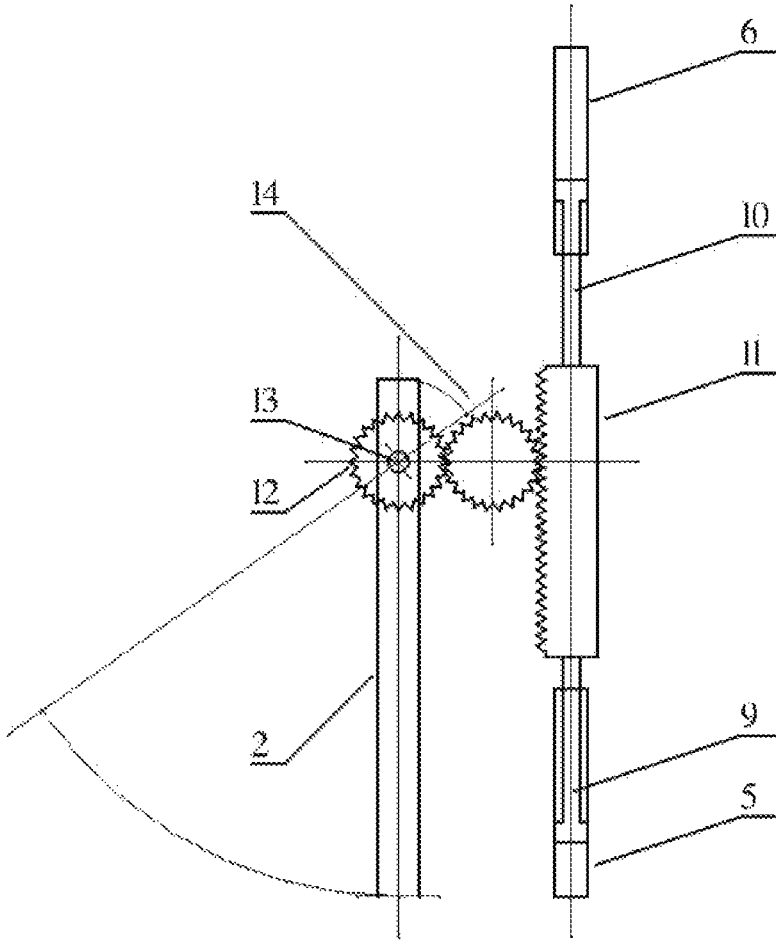
FIG. 3 is a side view of the ramp lowering mechanism corresponding to the situation while the ramp is fully lowered.

The embodiment of the invention shows a launching arrangement of a lifeboat 1 with a movable ramp 2 mounted on the ramp axle 13 and wire ropes 7 of the ramp winch 4, which allows for lowering it from under the lifeboat 1. The ramp 2 enables the lifeboat 1 to be launched by free fall, and the possibility of gravitationally lowering the ramp 2 from under the lifeboat 1 allows the lifeboat 1 to be launched gravitationally by fall of a lifeboat winch 3.

By using the method of suspending the lifeboat 1 onto wire ropes 18 of the lifeboat winch 3 described in U.S. Pat. No. 9,902,470, the second method of launching the lifeboat 1 by fall of the lifeboat winch 3 of the described arrangement complies with the requirements and standards for this arrangement.

Lowering the ramp 2 consists in using the simultaneous effect of the power hydraulic mechanism and of the ramp winch 4. The power hydraulic mechanism consists of two identical hydraulic cylinders 5 and 6, gear bar 11 and two gearwheels 12 and 14. The piston rods 9 and 10 of the hydraulic cylinders 5 and 6 are connected to the ends of the gear bar 11, which interacts with the gearwheel 12 of the ramp axle 13 through an additional identical gearwheel 14 which allows for converting the linear movement of the piston rods 9 and 10 of the cylinders 5 and 6 into a rotational movement of the ramp axle 13. The two wire ropes 7 of the ramp winch 4 are connected to the ramp 2 through rotatable links 8.

The ramp 2 is lowered by releasing the brake of the ramp winch 4. The brake of the ramp winch 4 can be released directly from the location of the ramp winch 4 or indirectly from the inside of the lifeboat 1, which allows for stopping the lowering of the ramp 2 at any time.

During the lowering the ramp 2, after the brake of the ramp winch 4 is released, the oil of the lower hydraulic cylinder 5 is pressed into the upper hydraulic cylinder 6 due to the effect of the weight of the ramp 2 on the extended piston rod 9 of the lower hydraulic cylinder 5 through the arrangement of the two gearwheels 12 and 14 and the gear bar 11. The possibility of using a control system for the oil flow rate from the lower hydraulic cylinder 5 to the upper hydraulic cylinder 6 allows for designating the speed of movement of the piston rods 9 and 10 of the hydraulic cylinders 5 and 6 and for determining a safe lowering speed of the ramp 2, The ramp 2 is raised by the ramp winch 4 pulling the wire ropes 7. The ramp 2 is raised up to the initial position determined by the limit switch 15 of the power supply of the ramp winch 4, The limit switch 15 cuts off the power supply of the ramp winch 4 when the piston rod 10 of the upper cylinder 6 is fully inserted.

The lifeboat 1 is ready to be launched when on the ramp 2, its outer deck 28 is supported on the horizontal rollers 24 of the ramp 2, the chains 19 of the spreader 20 are pulled and the chain 22 which serves to keep the lifeboat 1 is in its initial position on the ramp 2 is tightened. The lifeboat 1 may be embarked by platform 23.

The launching of the lifeboat 1 by free fall consists in opening the hooks 17 and removing the chains 19 of the spreader 20 therefrom, and then releasing the chain 22 holding the lifeboat 1 on the ramp 2 by opening the aft hook 21. This results in the lifeboat 1 descending on horizontal rollers 24 from the ramp 2 and free falling into the water. The vertical rollers 25 of the ramp 2 stabilize the descent of the lifeboat 1 from the ramp 2.

The gravitational launching of the lifeboat 1 by fall of the lifeboat winch 3 consists in releasing the chain 22 holding the lifeboat 1 on the ramp 2 from the aft hook 21 of the lifeboat 1, lowering the ramp 2 from under the lifeboat 1 and lowering the lifeboat 1 into the water and releasing the chains 19 of the spreader 20 from the hooks 17 of the lifeboat 1. The hooks 17 are part of the lifeboat suspension system on the wire ropes 18 of the lifeboat winch 3 using triangular frames 16 arranged on both sides of the lifeboat 1.

The lifeboat 1 is lowered into the water by releasing the brake of the lifeboat winch 3. The brake of the lifeboat winch 3 can be released directly from the location of the lifeboat winch 3 or indirectly from the inside of the lifeboat 1, which allows for stopping the lowering of the lifeboat 1 at any time.

Lifting the lifeboat 1 out of the water and placing the lifeboat 1 on the ramp 2 in position ready for launching is done by using the lifeboat winch 3 to hoist the lifeboat 1 to the initial height and the ramp winch 4 to raise the ramp 2 to the initial height.

After connecting the chains 19 of the spreader 20 to the hooks 17 of the lifeboat 1, the lifeboat 1 can be hoisted to the initial height by using the limit switch system to cut off the power supply of the lifeboat winch 3.

The lifeboat 1 is placed on the ramp 2 in position ready for launching after the ramp 2 is raised to the initial position by the ramp winch 4 and using the turnbuckle 26 of the chain 22, which is connected to the fixed element 27 of the structure of the ramp 2, which allows for adjusting how tightened it is.

LIST OF COMPONENTS OF THE EMBODIMENT

1—lifeboat
2—ramp
3—lifeboat winch
4—ramp winch
5—lower hydraulic cylinder
6—upper hydraulic cylinder
7—wire rope of the ramp winch
8—rotatable link of the ramp with the wire rope of the ramp winch
9—piston rod of the lower hydraulic cylinder
10—piston rod of the upper hydraulic cylinder
11—gear bar
12—gearwheel of the ramp axle
13—ramp axle
14—additional gearwheel
15—limit switch of the ramp winch
16—triangular frame of the suspension system of the lifeboat
17—frame hook of the mechanism releasing the lifeboat of the launching arrangement by falls
18—wire rope of the lifeboat winch
19—chain of the spreader
20—spreader
21—aft hook of the mechanism releasing the lifeboat of the launching arrangement by free fall
22—chain of the aft hook
23—lifeboat embarkation platform
24—horizontal rollers of the ramp
25—vertical rollers of the ramp
26—turnbuckle of the aft hook chain
27—fixed element of the ramp structure
28—outer deck of the lifeboat

The invention claimed is:

1. An arrangement for evacuating people from an offshore installation having a lifeboat and an arrangement for a free-fall based lifeboat launch with a tilted moveable ramp; characterised in that the ramp (2) of the lifeboat launching arrangement has a ramp axle (13) and a wire rope winch (4); and the lifeboat launching arrangement has a power hydraulic mechanism of the ramp (2), which consists of an arrangement of two identical lower (5) and upper (6) hydraulic cylinders, having piston rods (9, 10), a gear bar (11), a gearwheel (12) of the ramp axle (13) and an additional gearwheel (14), wherein the piston rods (9, 10) are arranged on two opposite sides of the gear bar (11) and the piston rods (9, 10) are connected to the ends of the gear bar (11), and the gear bar (11) engages with the additional gearwheel (14) engaging with the gearwheel (12) of the ramp axle (13).

* * * * *